US008844984B2

(12) United States Patent
Kurebayashi

(10) Patent No.: US 8,844,984 B2
(45) Date of Patent: Sep. 30, 2014

(54) DOOR LOCK DEVICE

(75) Inventor: Hayato Kurebayashi, Fukuoka (JP)

(73) Assignee: Shiroki Corporation, Kanagawa (JP)

( * ) Notice: Subject to any disclaimer, the term of this patent is extended or adjusted under 35 U.S.C. 154(b) by 81 days.

(21) Appl. No.: 13/491,869

(22) Filed: Jun. 8, 2012

(65) Prior Publication Data

US 2012/0248796 A1 Oct. 4, 2012

Related U.S. Application Data

(63) Continuation of application No. PCT/JP2010/071083, filed on Nov. 26, 2010.

(30) Foreign Application Priority Data

Dec. 10, 2009 (JP) ..... 2009-280969

(51) Int. Cl.

| | |
|---|---|
| ***E05C 3/06*** | (2006.01) |
| ***E05B 85/26*** | (2014.01) |
| *E05C 3/16* | (2006.01) |
| *E05B 81/20* | (2014.01) |
| *E05B 85/02* | (2014.01) |

(52) U.S. Cl.

CPC ..... *E05B 85/26* (2013.01); *E05B 81/21* (2013.01); *E05B 81/20* (2013.01); *E05B 85/02* (2013.01); *Y10S 292/23* (2013.01)

USPC ..... 292/201; 292/216; 292/DIG. 23

(58) Field of Classification Search

USPC ..... 292/201, 216, DIG. 23, DIG. 29, 292/DIG. 42, DIG. 43

See application file for complete search history.

(56) References Cited

U.S. PATENT DOCUMENTS

| | | | | | |
|---|---|---|---|---|---|
| 4,892,339 | A | * | 1/1990 | Kleefeldt et al. | 292/201 |
| 5,183,300 | A | * | 2/1993 | Bonne et al. | 292/216 |
| 5,423,582 | A | * | 6/1995 | Kleefeldt | 292/201 |
| 5,433,496 | A | * | 7/1995 | Zimmermann | 292/201 |

(Continued)

FOREIGN PATENT DOCUMENTS

| | | | |
|---|---|---|---|
| JP | 11-236776 | A | 8/1999 |
| JP | 3160553 | B2 | 2/2001 |
| JP | 2006-328708 | A | 12/2006 |
| JP | 2009-299313 | A | 12/2009 |

OTHER PUBLICATIONS

International Search Report of PCT/JP2010/071083 (Feb. 18, 2011).

*Primary Examiner* — Kristina Fulton
*Assistant Examiner* — Alyson M Merlino
(74) *Attorney, Agent, or Firm* — Millen, White, Zelano & Branigan, P.C.

(57) ABSTRACT

A door lock device is disclosed, wherein if positioning of an interlinking lever and a closing ver is performed using the biasing force of a biaser when the hook is in the striker releasing position, subsequent rotations of the interlinking lever and the control lever are prevented from becoming unsmooth.

The door lock device is provided with a control slot which moves the interlinking lever toward the coupling position, which moves the interlinking lever toward the coupling disengaging position via the control projection when the control lever rotates toward the coupling disengagement assisting position and which is formed in said control lever, and a stopper which prevents the closing lever from rotating to the draw-in releasing position by the biasing force of the closing lever biaser to thereby make the control projection spaced from an end surface of the control slot.

6 Claims, 12 Drawing Sheets

(56) References Cited

U.S. PATENT DOCUMENTS

| | | | | | |
|---|---|---|---|---|---|
| 5,531,488 | A * | 7/1996 | Yoshikuwa et al. | 292/216 |
| 5,618,068 | A * | 4/1997 | Mitsui et al. | 292/201 |
| 5,765,884 | A * | 6/1998 | Armbruster | 292/216 |
| 5,769,468 | A * | 6/1998 | Armbruster | 292/201 |
| 5,938,252 | A * | 8/1999 | Uemura et al. | 292/201 |
| 6,145,354 | A * | 11/2000 | Kondo et al. | 70/279.1 |
| 6,338,508 | B1 * | 1/2002 | Kleefeldt | 292/201 |
| 2002/0070564 | A1 * | 6/2002 | Ohta et al. | 292/201 |
| 2004/0056489 | A1 * | 3/2004 | Boecker et al. | 292/201 |
| 2005/0082842 | A1 * | 4/2005 | Warmke et al. | 292/216 |
| 2006/0055181 | A1 * | 3/2006 | Berghahn et al. | 292/216 |
| 2010/0013246 | A1 * | 1/2010 | Tomaszewski et al. | 292/216 |
| 2010/0127511 | A1 * | 5/2010 | Vasquez et al. | 292/201 |
| 2010/0244466 | A1 * | 9/2010 | Tomaszewski | 292/201 |
| 2011/0084504 | A1 * | 4/2011 | Kurebayashi et al. | 292/97 |

* cited by examiner

DOOR LOCK DEVICE

RELATED APPLICATION DATA

This is a continuation of International Application No. PCT/JP2010/071083, with an international filing date of Nov. 26, 2010, which is herein incorporated by reference in its entirety.

TECHNICAL FIELD

The present invention relates to a door lock device for locking and unlocking a door installed in a vehicle.

BACKGROUND ART

Among known door lock devices, a type of door lock device (a so-called door closer) that is capable of automatically fully-closing a door by a motor-operated driving mechanism, having a drive source such as a motor, when the door is manually closed is known in the art.

As an example of this type of door lock device, a door lock device is known in the art which is provided on a vehicle body with a striker that projects therefrom, whereas on a door is provided with a hook capable of being engaged with and disengaged from the striker, an interlinking lever capable of being engaged with and disengaged from the hook, a closing lever which rotates by power from an electrical drive mechanism and is connected to the interlinking lever in a manner to be capable of rotating with the interlinking lever, and an opening lever (control lever) which rotates by an operation of an open switch, etc., provided on the vehicle and includes a control groove in the shape of an elongated groove which receives a control projection, formed on the interlinking lever, in a manner to allow the control projection of the interlinking lever to move relative to the control groove. The hook is rotatable between a striker holding position for holding the striker, a striker releasing position for releasing the striker, and a draw-in commencement position (half-latched position) between the striker holding position and the striker releasing position. The interlinking lever is disengaged from the hook when the hook is in the striker releasing position, and is engaged with the hook to temporarily hold the hook in the draw-in commencement position upon the hook rotating to the draw-in commencement position. A motor of the electrical drive mechanism rotates (rotates in the forward direction) upon the hook moving to the draw-in commencement position, and transmission of this rotational force to the interlinking lever via the closing lever causes the hook having rotated to the draw-in commencement position to rotate to the striker holding position via the interlinking lever.

CITATION LIST

Patent Literature

PATENT LITERATURE 1: Japanese Unexamined Patent Publication No. H11-236776

SUMMARY OF THE INVENTION

Technical Problem

As an example of the aforementioned type of door lock device, a structure is conceivable in which the positioning of the closing lever and the interlinking lever when the hook is in the striker releasing position is performed by positioning the control projection at one end of the control groove in the lengthwise direction thereof when the hook is positioned in the release position in a state where the closing lever is biased to rotate in one direction by a spring (biaser) while the interlinking lever is biased to rotate in one direction by use of this rotational biasing force of the aforementioned spring.

With the adoption of such a structure, if, e.g., both ends of the control groove in the lengthwise direction thereof are closed like Patent Literature 1, the control projection of the interlinking lever comes into pressing contact with one end of the control groove (end surface of the control groove in the lengthwise direction thereof) with a strong force by the biasing force of the aforementioned spring, which biases and rotates the closing lever, when the hook is positioned in the striker releasing position. However, in the case where, e.g., a corner portion of the control projection and a corner portion of the aforementioned one end of the control groove are both square in shape, there is a possibility of the corner portion of the control projection digging into the one end of the control groove with a strong force when the hook is positioned in the striker releasing position, which may cause rotations of the interlinking lever and the opening lever to become unsmooth when the hook rotates toward the striker holding position by the striker.

In addition, the inner side of the control groove of the opening lever generally includes an operational section that is formed on the assumption that it contacts the control projection, and a non-operational section that is formed on the assumption that it does not contact the control projection. Therefore, biasing the closing lever to rotate in one direction by a spring (biaser) may cause the control projection of the interlinking lever to move into the non-operational section when the hook is positioned in the striker releasing position, and rotations of the interlinking lever and the opening lever may become unsmooth when the hook is about to rotate toward the striker holding position by the striker.

The present invention has been devised in view of the above described problems, and the present invention provides a door lock device, wherein in the case where the positioning of the interlinking lever, which includes a control projection that is movably engaged in a control groove of a control lever, and the closing lever, which is rotatably connected to the interlinking lever, is carried out using the biasing force of a biaser when the hook is in the striker releasing position, the subsequent rotations of the interlinking lever and the control lever are made so as not to be unsmooth.

Solution to Problem

The door lock device according to the present invention is characterized by a door lock device for holding a door in a fully-closed state, the door being capable of being opened and closed relative to a vehicle body, the door lock device including a base plate and a striker which are installed to one and the other of the door and the vehicle body; a hook which is supported by the base plate to be rotatable between a striker holding position for holding the striker, a striker releasing position for releasing the striker and a draw-in commencement position between the striker holding position and the striker releasing position, the hook being biased toward the striker releasing position; a closing lever which is supported by the base plate thereon to be rotatable coaxially with the hook and rotates between a draw-in position, at which the closing lever is positioned toward the striker holding position of the hook, and a draw-in releasing position, at which the closing lever is positioned toward the striker releasing position of the hook; a motor-operated driving mechanism provided with a motor which does not operate when the hook is located at a position toward the striker releasing position from the draw-in commencement position, and which operates to rotate the closing lever to the draw-in position when the hook moves to the draw-in commencement position from the striker releasing position side; a closing lever biaser which biases the closing lever toward the draw-in releasing position; an interlinking lever which is pivoted on the closing lever and rotatable between a coupling position at which the interlinking lever is engaged with the hook so as to make the closing lever and the hook integral with each other via the interlinking lever, and a coupling disengaging position at which the interlinking lever is disengaged from the hook to allow the closing lever and the hook to rotate relative to each other; a control lever which is rotatably supported by the base plate thereon and rotates between a coupling assisting position and a coupling-disengagement assisting position; a control lever biaser which biases the control lever toward the coupling assisting position; a control slot which is composed of an elongated hole formed in the control lever, in which the control projection is engaged to be movable relative to the control slot, which moves the interlinking lever toward the coupling position via the control projection when the control lever rotates toward the coupling assisting position, and which moves the interlinking lever toward the coupling disengaging position via the control projection when the control lever rotates toward the coupling-disengagement assisting position; and a stopper which prevents the closing lever rotated to the draw-in releasing position from rotating by a biasing force of the closing lever biaser to thereby make the control projection spaced from an end surface of the control slot in a lengthwise direction thereof.

The door lock device according to another aspect of the present invention, a door lock device is provided for holding a door in a fully-closed state, the door being capable of being opened and closed relative to a vehicle body, the door lock device including a base plate and a striker which are installed to one and the other of the door and the vehicle body; a hook which is supported by the base plate to be rotatable between a striker holding position for holding the striker, a striker releasing position for releasing the striker and a draw-in commencement position between the striker holding position and the striker releasing position, the hook being biased toward the striker releasing position; a closing lever which is supported by the base plate thereon to be rotatable coaxially with the hook and rotates between a draw-in position, at which the closing lever is positioned toward the striker holding position of the hook, and a draw-in releasing position, at which the closing lever is positioned toward the striker releasing position of the hook; a motor-operated driving mechanism provided with a motor which does not operate when the hook is located at a position toward the striker releasing position from the draw-in commencement position, and which operates to rotate the closing lever to the draw-in position when the hook moves to the draw-in commencement position from the striker releasing position side; a closing lever biaser which biases the closing lever toward the draw-in releasing position; an interlinking lever which is pivoted on the closing lever and rotatable between a coupling position at which the interlinking lever is engaged with the hook so as to make the closing lever and the hook integral with each other via the interlinking lever and a coupling disengaging position at which the interlinking lever is disengaged from the hook to allow the closing lever and the hook to rotate relative to each other; a control lever which is rotatably supported by the base plate thereon and rotates between a coupling assisting position and a coupling-disengagement assisting position; a control lever biaser which biases the control lever toward the coupling assisting position; a control slot which is composed of an elongated hole formed in the control lever, and which includes an operational section and a non-operational section, wherein the operational section is for moving the interlinking lever toward the coupling position by making an inner surface of the operational section in contact with the control projection, which is relatively movably engaged in the control slot, when the control lever rotates toward the coupling assisting position and for moving the interlinking lever toward the coupling disengaging position when the control lever rotates toward the coupling-disengagement assisting position, and wherein an inner surface of the non-operational section does not come in contact with the control projection; and a stopper which prevents the closing lever rotated to the draw-in releasing position from rotating by a biasing force of the closing lever biaser to thereby position the control projection in the operational section of the control slot.

It is desirable for the stopper to prevent the closing lever in the draw-in releasing position from rotating at all times when the hook is positioned in one of the striker releasing position, the draw-in commencement position and a position between the striker releasing position and the draw-in commencement position.

It is desirable for the stopper to include a stopper member provided on the base plate, and a stopper surface formed on the closing lever.

Advantageous Effects of the Invention

According to the present invention, the biasing force of the closing lever biaser is transmitted to the interlinking lever via the closing lever; however, upon the closing lever being positioned in the draw-in releasing position by the stopper (i.e., upon the hook being positioned in the striker releasing position), the control projection of the interlinking lever is held at a position spaced from an end surface of the control groove of the opening lever in the lengthwise direction thereof. Therefore, the control projection does not dig into the end surface of the control groove in the lengthwise direction thereof, and accordingly, when the hook is rotated toward the striker holding position by the striker afterwards, rotations of the interlinking lever and the opening lever do not become unsmooth, so that the door lock device can move to a locked state smoothly.

According to another aspect of the present invention, upon the closing lever being positioned in the draw-in releasing position by the stopper (i.e., upon the hook being positioned in the striker releasing position), the control projection is positioned at the operational section of the control groove. Accordingly, when the hook is rotated toward the striker holding position by the striker thereafter, rotations of the interlinking lever and the opening lever do not become unsmooth, so that the door lock device can move to a locked state smoothly.

EMBODIMENT

Figure 1:
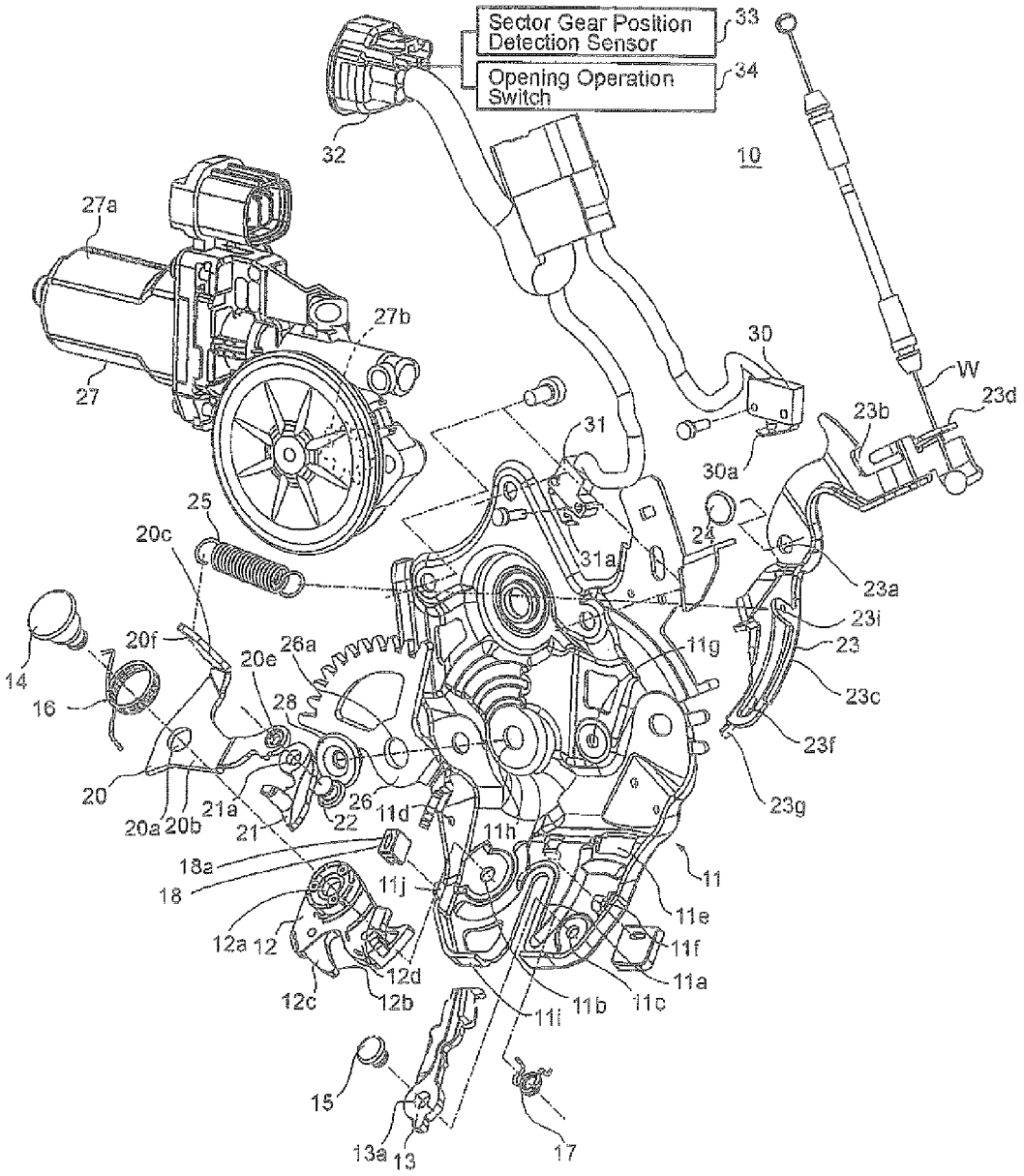
FIG. 1 is an exploded perspective view of a door lock device according to the present invention.

A door lock device according to the present invention will be described below based on the accompanying drawings. The door lock device (door closer) 10 shown in the drawings is installed on a trunk door not shown in the drawings, while a striker S (FIGS. 9 through 1) which is engaged with and disengaged from the door lock device 10 is installed on a vehicle body that supports the trunk door in a manner to allow the trunk door to be opened and closed. In this connection, it is possible to reverse the positional relationship between the door lock device 10 and the striker S.

As shown in FIG. 1, the door lock device 10 is provided with a base plate 11 which is fixedly mounted to the trunk door. A striker entry groove 11*a* into which the striker S can enter is formed in the base plate 11, and pivots 14 and 15 are fixed to pivot support holes 11*b* and 11*c* positioned on both sides of the striker entry groove 11*a*, respectively. The pivot 14 is inserted into a pivotal hole 12*a* formed in a hook 12, and the hook 12 is supported by the pivot 14 to be rotatable about the pivot 14. The pivot 15 is inserted into a pivotal hole 13*a* formed in a latch 13, and the latch 13 is supported by the pivot 15 to be rotatable about the pivot 15. In addition, a support lug 11*j* is projected integrally from an upright wall portion 11*i* of the base plate 11 that is positioned in the vicinity of the hook 12, and a stopper member (stopper) 18 that is made of an elastic material such as rubber is fitted at a support through-hole 18*a* thereof on the support lug 11*j* and fixed thereto with the use of the elastic force of the stopper member 18 itself.

Figure 2:
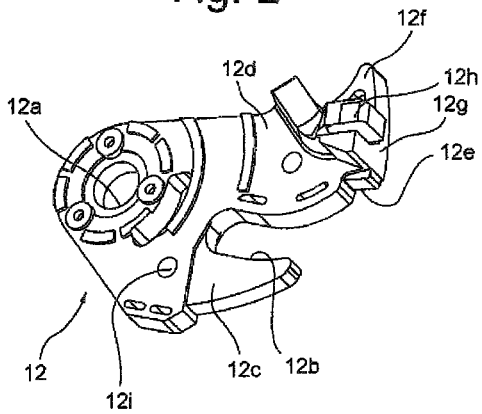
FIG. 2 is a perspective view of a hook of the door lock device.

As shown in FIG. 2, the hook 12 is provided with a striker holding groove 12*b* elongated in a substantially radial direction about the pivotal hole 12*a*, and a first leg portion 12*c* and a second leg portion 12*d* which are positioned on both sides of the striker holding groove 12*b*, respectively. The hook 12 is provided, in the vicinity of an end of the second leg portion 12*d* on a side thereof which faces the striker holding groove 12*b*, with a latch-engaging stepped portion (engaging portion) 12*e*, and is provided in the vicinity of the end of the second leg portion 12*d* on the opposite side thereof with a latch pressure projection (latch controller) 12*f*. In addition, the end edge of the second leg portion 12*d*, which connects the latch-engaging stepped portion 12*e* and the latch pressure projection 12*f* to each other, is formed into a convex-shaped circular arc surface (latch controller/latch holder) 12*g*. Additionally, a coupling projection (opening lever holder) 12*h* is formed on the second leg portion 12*d* to project in a direction away from the base plate 11. The hook 12 is rotatable between a striker releasing position shown in FIG. 9 and a striker holding position shown in FIG. 11, and is biased to rotate toward the striker releasing position (clockwise direction with respect to FIGS. 9 through 11) by a torsion spring 16. The torsion spring 16 is provided with a coiled portion which surrounds the pivot 14 and a pair of spring ends which are engaged with a spring hooking hole 12*i* of the hook 12 and a spring hooking hole 11*d* of the base plate 11, respectively.

Figure 3:
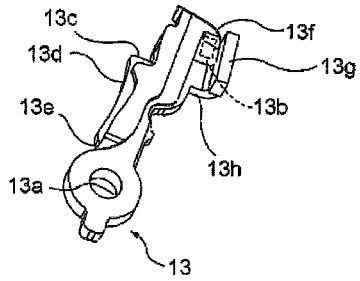
FIG. 3 is a perspective view of a latch of the door lock device.

As shown in FIG. 3, the latch 13 is provided with a guide projection 13*b* which is engaged with a latch guide groove 11*e* formed in the base plate 11 to be freely slidable thereon. The latch 13 is provided on a side thereof facing the hook 12 with a rotation-restriction stepped portion 13*c* that is engageable with the latch-engaging stepped portion 12*e*. A circular arc surface (latch controller/latch holder) 13*d*, the concave shape of which corresponds to the convex-shaped circular arc surface 12*g*, is formed on a side surface of the latch 13 which is continuous with the rotation-restriction stepped portion 13*c*, and a smoothly-stepped portion (latch controller) 13*e* is formed on a portion of the concave-shaped circular arc surface 13*d* in the vicinity of the base end of the latch 13 toward the pivotal hole 13*a*. Additionally, the latch 13 is provided, in the vicinity of the end thereof that is distant from the pivotal hole 13*a*, with a switch operating piece 13*f*, and is provided with a pressed piece (latch controller/interlinking-lever linkup portion) 13*g* on the opposite side of the latch 13 from the concave-shaped circular arc surface 13*d*. The latch 13 is rotatable between a latching position (FIGS. 9 and 11) in which the latch 13 is positioned close to the hook 12 so that the rotation-restriction stepped portion 13*c* is positioned on a moving path of the latch-engaging stepped portion 12*e* thereof (in which the rotation-restriction stepped portion 13*c* is engageable with the latch-engaging stepped portion 12*e*) and an unlatching position (FIG. 10) in which the rotation-restriction stepped portion 13*c* is retracted from a position on the moving path of the latch-engaging stepped portion 12*e* (in which the rotation-restriction stepped portion 13*c* is not engageable with the latch-engaging stepped portion 12*e*), and is biased to rotate toward the latching position (in the counterclockwise direction with respect to FIGS. 9 through 11) by a torsion spring (latch biaser) 17. The torsion spring 17 is provided with a coiled portion which surrounds the pivot 15 and a pair of spring ends which are engaged with a spring hooking portion 13*h* of the latch 13 and a spring hooking hole 11*f* of the base plate 11, respectively.

Figure 4:
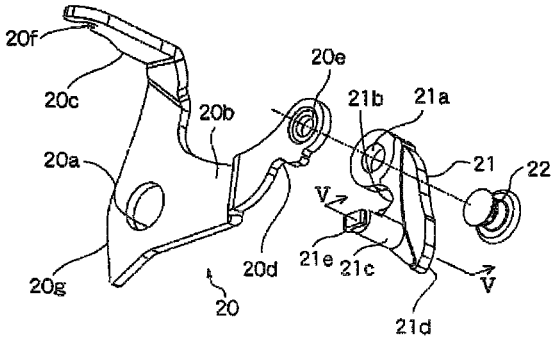
FIG. 4 is a perspective view of a closing lever and an interlinking lever of the door lock device.

The pivot 14 is also inserted into a pivotal hole 20*a* of a closing lever 20, and the closing lever 20 is supported by the pivot 14 to be rotatable independently about the pivot 14 relative to the hook 12. As shown in FIG. 4, the closing lever 20 is L-shaped, has a first arm 20*b* and a second arm 20*c* which extend radially about the pivotal hole 20*a*, and is rotatable between a draw-in releasing position (FIGS. 9 and 10) in which the closing lever 20 is positioned toward the striker releasing position of the hook 12, which rotates coaxially with the closing lever 20, and a draw-in position (FIG. 11) in which the closing lever 20 is positioned toward the striker holding position of the hook 12. As shown in the drawings, the draw-in releasing position is defined by the engagement of a stopper surface (stopper) 20*g* which is formed on a side surface of the closing lever 20 with a side surface of the stopper member 18.

A recess 20*d* with which the coupling projection 12*h* of the hook 12 can come into contact and a pivot support hole 20*e* in which a pivot 22 is inserted to be supported thereby are formed on the first arm 20*b* of the closing lever 20 in the vicinity of the end of the first arm 20*b*. The pivot 22 is inserted into a pivotal hole 21*a* of an interlinking lever (latch controller) 21, and the interlinking lever 21 is pivoted on the closing lever 20 to be rotatable about the pivot 22. As shown in FIG. 4, the interlinking lever 21 is provided on a side thereof with a coupling recess 21*b* having a shape corresponding to the shape of the coupling projection 12*h*, and is rotatable between a coupling position (in which the interlinking lever 21 is engageable with the coupling projection 12*h*) (FIGS. 10 and 11) in which the coupling recess 21*b* is positioned on a moving path of the coupling projection 12*h* of the hook 12 and a coupling disengaging position (in which the interlinking lever 21 is not engaged with the coupling projection 12*h*) (FIG. 9) in which the coupling recess 21*b* is retracted from the moving path of the coupling projection 12*h* of the hook 12. The interlinking lever 21 is further provided in the vicinity of the coupling recess 21*b* with a control projection 21*c* having a substantially cylindrical columnar shape which projects in a direction away from the base plate 11, and is provided at an end of the control projection 21*c* with a retaining projection 21*e* which projects in a direction substantially orthogonal to the control projection 21*c*. In addition, the interlinking lever 21 is provided with a latch pressure projection 21*d* at the end of the interlinking lever 21 on the opposite side from the base end thereof that includes the pivotal hole 21*a*.

Figure 5:
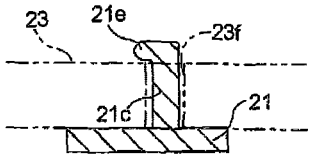
FIG. 5 is a cross sectional view of the interlinking lever taken along the line V-V shown in FIG. 4, viewed along the direction of the appended arrows.
Figure 6:
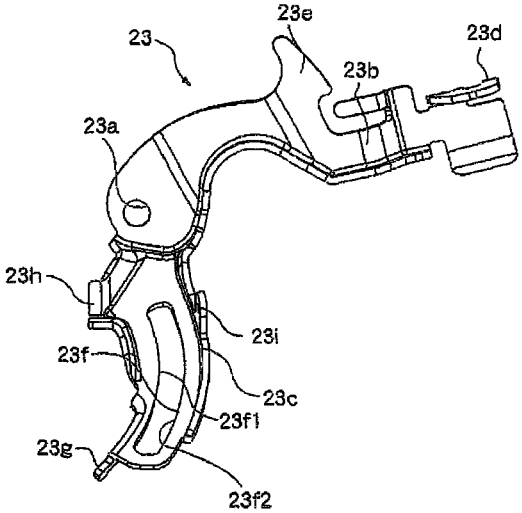
FIG. 6 is a perspective view of an opening lever of the door lock device.
Figure 9:
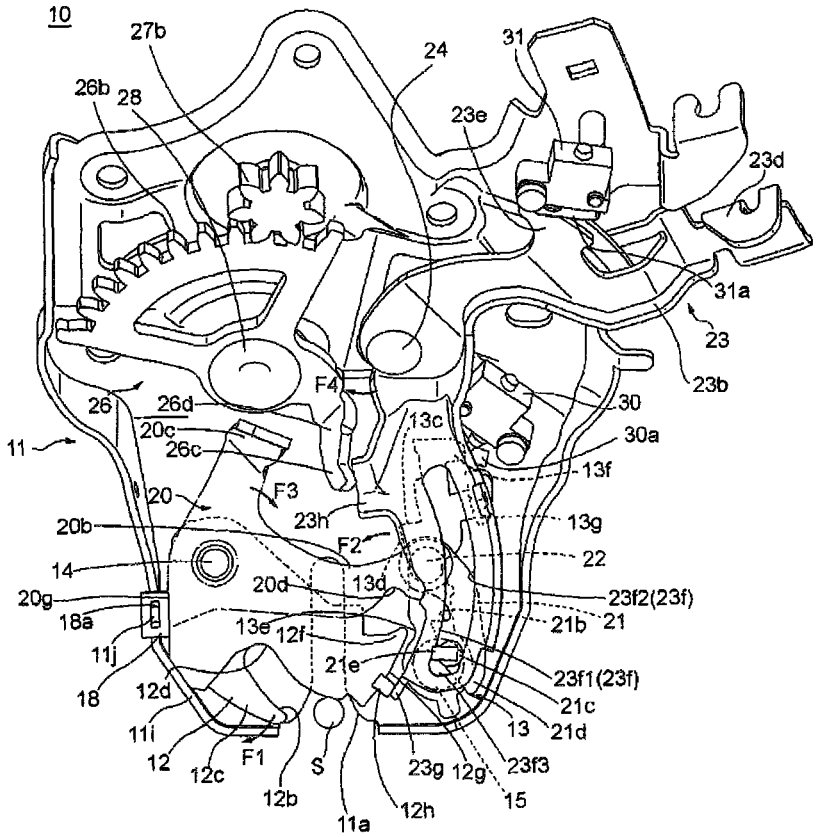
FIG. 9 is a plan view of the door lock device.
Figure 10:
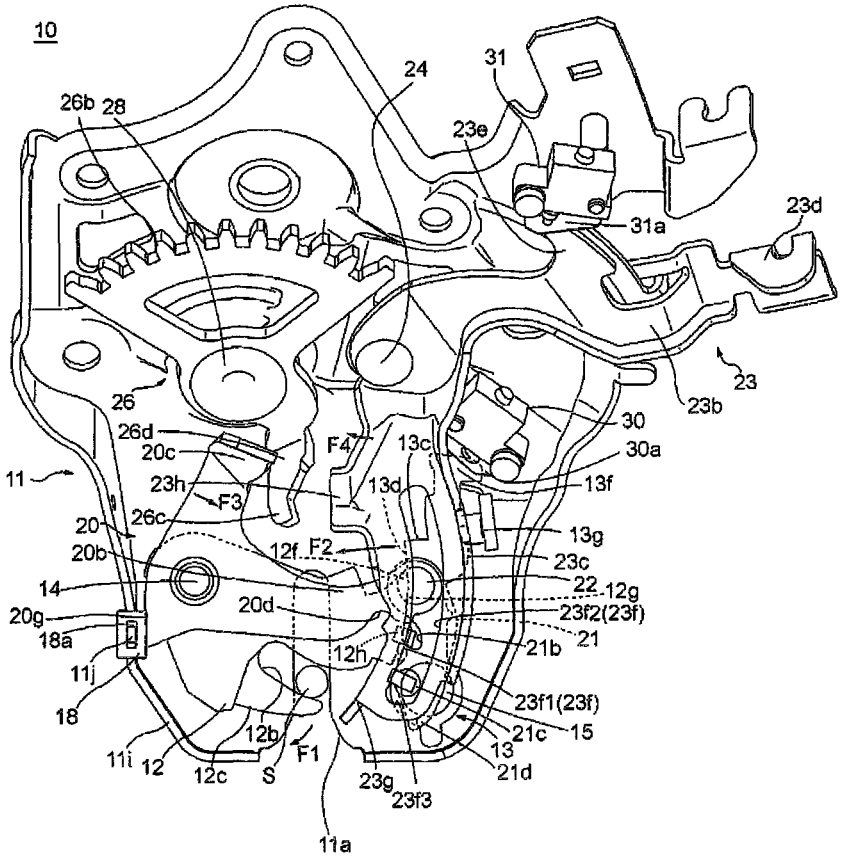
FIG. 10 is a plan view of the door lock device in a half-latched state.
Figure 11:
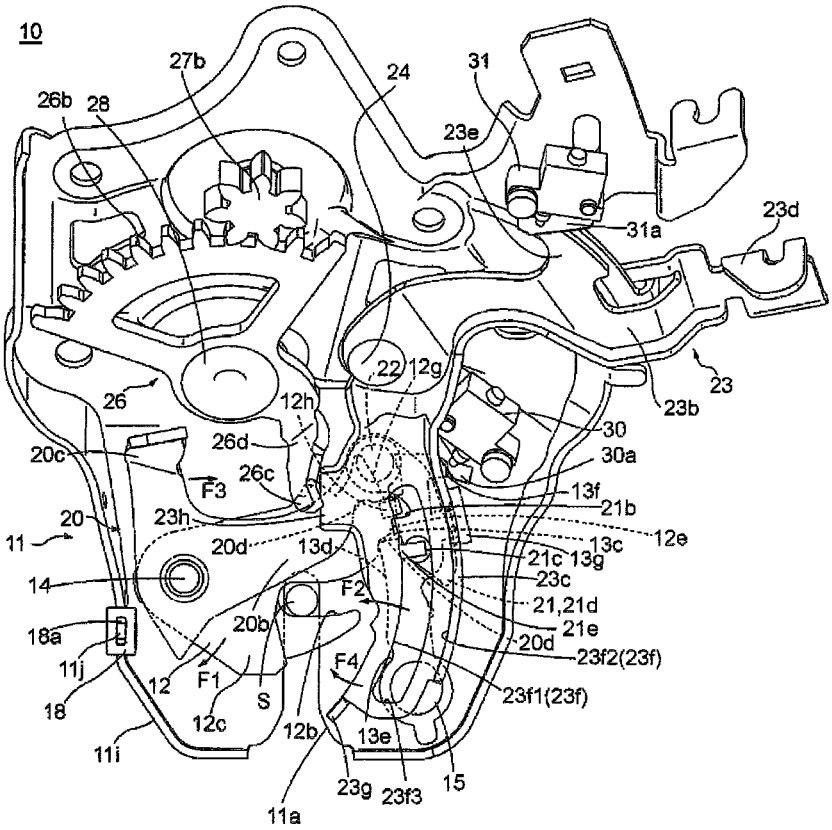
FIG. 11 is a plan view of the door lock device in a state where the operation to a fully-latched state has been completed.
Figure 12:
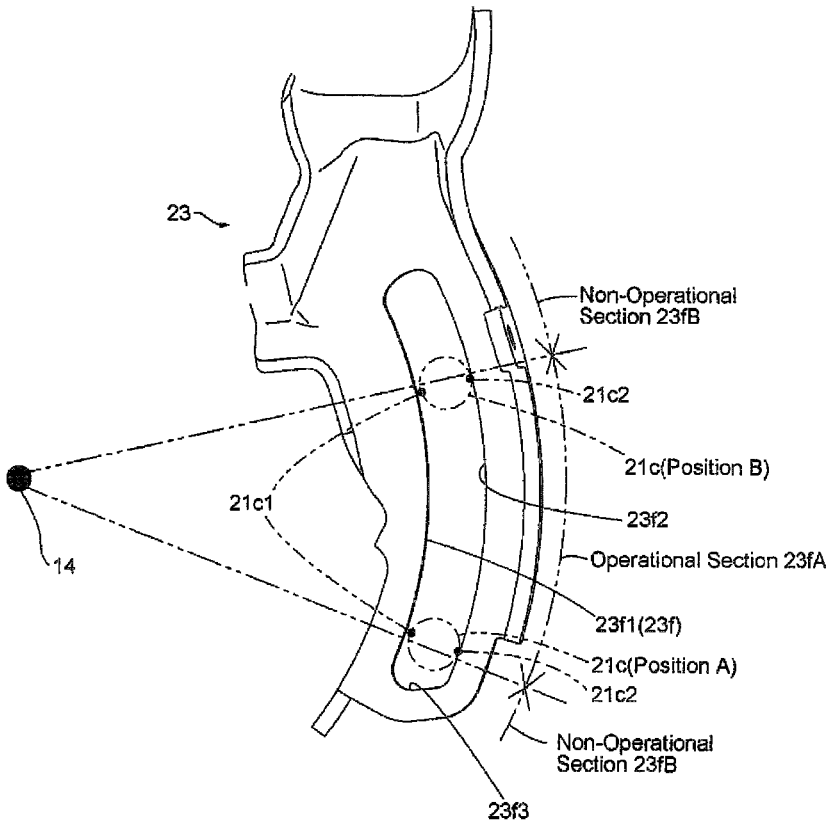
FIG. 12 is an enlarged plan view of a control groove of the opening lever.

A pivot 24 is fixed to a pivot support hole 11*g* of the base plate 11, and a pivotal hole 23*a* formed in an opening lever (control lever) 23 is rotatably fitted on the pivot 24. As shown in FIG. 6, the opening lever 23 is provided with a first arm 23*b* and a second arm (arm portion) 23*c* which extend in different directions with the pivotal hole 23*a* as the center. The opening lever 23 is provided in the vicinity of an end of the first arm 23*b* with a wire hooking portion 23*d* to which an opening operation wire W (FIG. 1) is connected, and provided at a midpoint between the pivotal hole 23*a* and the wire hooking portion 23*d* with a switch operating piece 23*e*. The opening operation wire W can be manually pulled by either one of a key apparatus and an emergency release handle not shown in the drawings. The second arm 23*c* is positioned to generally overlay the latch 13 as viewed in plan view as shown in FIGS. 9 through 11, and is provided with an interlinking-lever control slot (control slot/latch controller) 23*f* in which the control projection 21*c* of the interlinking lever 21 is inserted and which consists of an elongated hole, both ends of which in the lengthwise direction thereof are closed, a rotation restriction wall (opening lever holder) 23*g* that is capable of coming in contact with the coupling projection 12*h* of the hook 12, and a gear contact portion 23*h* which faces a sector gear 26, which will be discussed later. Insertion of the control projection 21*c* into the interlinking-lever control slot 23*f* causes the retaining projection 21*e* to face a surface of the opening lever 23 (see FIG. 5), and accordingly, the projection 21*c* does not unexpectedly come out of the interlinking-lever control slot 23*f*. The interlinking-lever control slot 23*f* is an elongated through-hole having a circular arc shape and includes an inner arc surface (projection operating surface) 23*f*1 and an outer arc surface (opposed guide surface) 23*f*2. Additionally, as shown in FIG. 12, the interlinking-lever control slot 23*f* can be divided into a pair of non-operational sections 23*f*B and an operational section 23*f*A, wherein the pair of non-operational sections 23*f*B constitute both ends of the interlinking-lever control slot 23*f*, respectively, and wherein the operational section 23*f*A is positioned between the pair of non-operational sections 23*f*B. The operational section 23*f*A is an area in which a contact portion (point) 21*c*1 or 21*c*2 of the control projection 21*c* comes into contact with an inner arc surface 23*f*1 or an outer arc surface 23*f*2, respectively, when the hook 12 is positioned between the striker releasing position and the striker holding position (including the striker releasing position and the striker holding position), while each non-operational section 23*f*B is an area in which neither of the contact portions (points) 21*c*1 and 21*c*2 of the control projection 21*c* comes into contact with the inner arc surface 23*f*1 or the outer arc surface 23*f*2 when the hook 12 is positioned between the striker releasing position and the striker holding position. Portions of the inner arc surface 23*f*1 and the outer arc surface 23*f*2 which are positioned in the operational section 23*f*A are each in the shape of a circular arc, and the centers of these circular arcs are coincident with the pivot 14 during the time the lock device 10 moves between a half-latched state and a fully-latched state (see FIG. 12). On the other hand, the non-operational sections 23*f*B are portions which are formed so as to allow both ends of a press mold which has the same cross sectional shape as the interlinking-lever control slot 23*f* to be smoothly drawn out from both ends of the interlinking-lever control slot 23*f* when the opening lever 23 is molded by press molding, and the shapes of the portions of the inner arc surface 23*f*1 and the outer arc surface 23*f*2 in the non-operational sections 23*f*B are different from the shapes of those in the operational section 23*f*A (i.e., the portions of the inner arc surface 23*f*1 and the outer arc surface 23*f*2 in the non-operational sections 23*f*B are not circularly arcuate in shape). The opening lever 23 is rotatable between a closing position (FIGS. 10 and 11; coupling assisting position) at which the second arm 23*c* thereof, which has the interlinking-lever control slot 23*f*, is displaced toward the latching position of the latch 13, and an opening position (FIG. 9; coupling-disengagement assisting position) at which the second arm 23*c* is displaced toward the unlatching position of the latch 13.

An extension spring (closing lever biaser/control lever biaser) 25 is extended and installed between a spring hook 20*f* formed on the second arm 20*c* of the closing lever 20 and a spring hook 23*i* formed on the second arm 23*c* of the opening lever 23. The closing lever 20 is biased to rotate toward the aforementioned draw-in releasing position (clockwise direction with respect to FIGS. 9 and 11), in which the stopper surface 20*g* comes in contact with a side surface of the stopper member 18, by the extension spring 25, while the opening lever 23 is biased to rotate toward the aforementioned closing position (clockwise direction with respect to FIGS. 9 and 11) by the extension spring 25.

Figure 7:
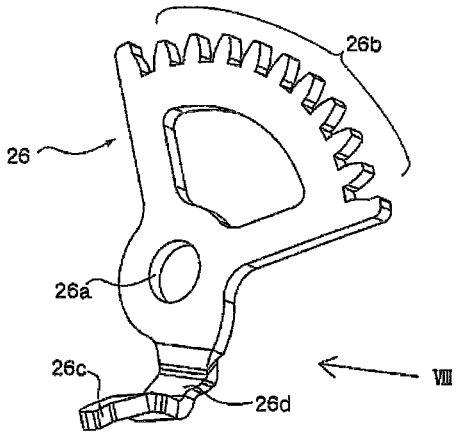
FIG. 7 is a perspective view of a sector gear of the door lock device.
Figure 8:
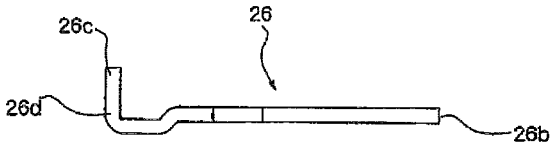
FIG. 8 is a side elevational view of the sector gear taken along the line VIII-VIII, viewed in the direction of the appended arrow.

A pivot 28 is fixed to a pivotal hole 11*h* of the base plate 11, and a pivotal hole 26*a* of the sector gear 26 is rotatably fitted on the pivot 28. The sector gear 26 is provided with a gear portion 26*b* which is formed on the outer edge of a sector portion about the pivotal hole 26*a*, an opening lever operating piece 26*c* which forms the opposite end of the sector gear 26 from the gear portion 26*b* and is capable of coming in contact with the gear contact portion 23*h* of the opening lever 23, and a closing lever operating portion 26*d* which is continuous with the opening lever operating piece 26*c* and capable of engaging with the second arm 20*c* of the closing lever 20. As shown in FIGS. 7 and 8, the opening lever operating piece 26*c* and the closing lever operating portion 26*d* are substantially orthogonal to the other part of the closing lever 20, and the closing lever operating portion 26*d* is formed to be greater in width than the opening lever operating piece 26*c*. Additionally, as shown in FIG. 8, the gear portion 26*b* and the closing lever operating portion 26*d* lie in a plane orthogonal to the pivot 28. A motor unit 27 fixed on the base plate 11 is provided with a pinion 27*b* which is driven to rotate forward and reverse by a motor 27*a*, and the pinion 27*b* is engaged with the gear portion 26*b*. The motor unit 27 and the sector gear 26 constitute a motor-operated driving mechanism.

A latch detection switch (detector/first switch) 30 and an opening lever detection switch (detector/second switch) 31 are mounted on the base plate 11. The latch detection switch 30 is a switch which can be pressed by the switch operating piece 13*f* that is provided on the latch 13, and the opening lever detection switch 31 is a switch which can be pressed by the switch operating piece 23*e* that is provided on the opening lever 23. More specifically, the latch detection switch 30 is in a switch-OFF state in which the switch operating piece 13*f* is spaced from a switch leaf 30*a* when the latch 13 is in the latching position shown in FIGS. 9 and 11, and the switch operating piece 13*f* presses the switch leaf 30*a* to thereby turn ON the latch detection switch 30 upon the latch 13 being rotated to the unlatching position shown in FIG. 10. In addition, the opening lever detection switch 31 is in a switch-OFF state in which the switch operating piece 23*e* is spaced from a switch leaf 31*a* when the opening lever 23 is in the closing position shown in FIGS. 10 and 11, and the switch operating piece 23*e* presses the switch leaf 31*a* to thereby turn ON the opening lever detection switch 31 upon the opening lever 23 being rotated to the opening position shown in FIG. 9. The ON/OFF states of the latch detection switch 30 and the opening lever detection switch 31 are input to an electronic control unit (ECU) 32, and the electronic control unit 32 controls the operation of the motor unit 27 in a manner which will be discussed later.

The door lock device 10 is provided with a sector gear position detection sensor 33 (FIG. 1) for detecting an initial position of the sector gear 26 and an opening operation switch 34 (FIG. 1) for performing a motor-driven opening operation. The sector gear position detection sensor 33 is configured from a Hall IC provided inside the motor unit 27 and shown conceptually outside of the motor unit 27 for the purpose of convenience.

Figure 13:
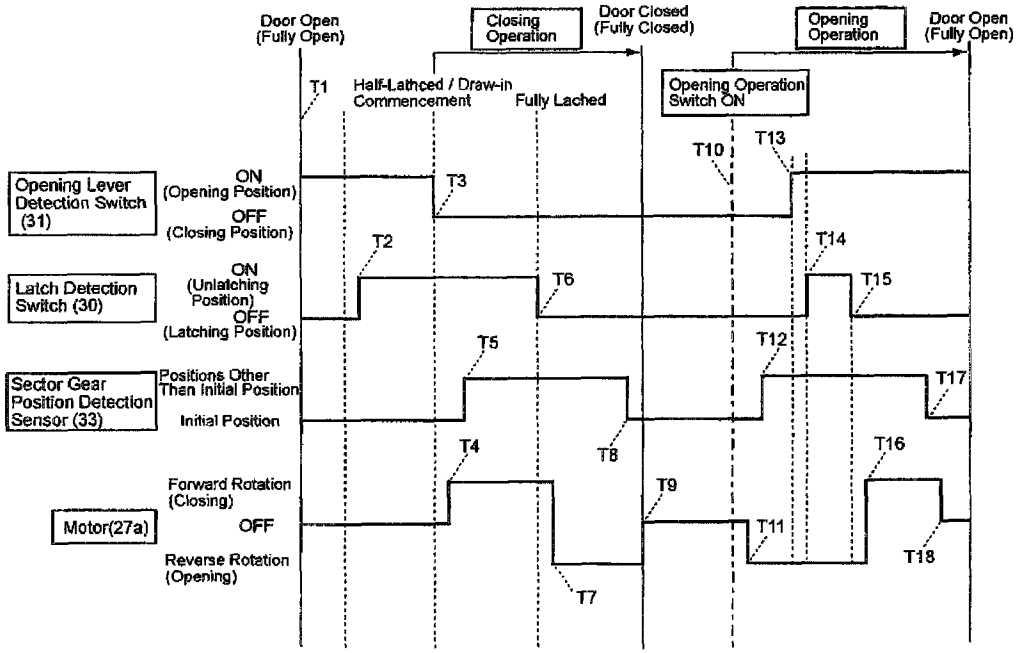
FIG. 13 is a timing chart showing a normal operating state of the door lock device.
Figure 14:
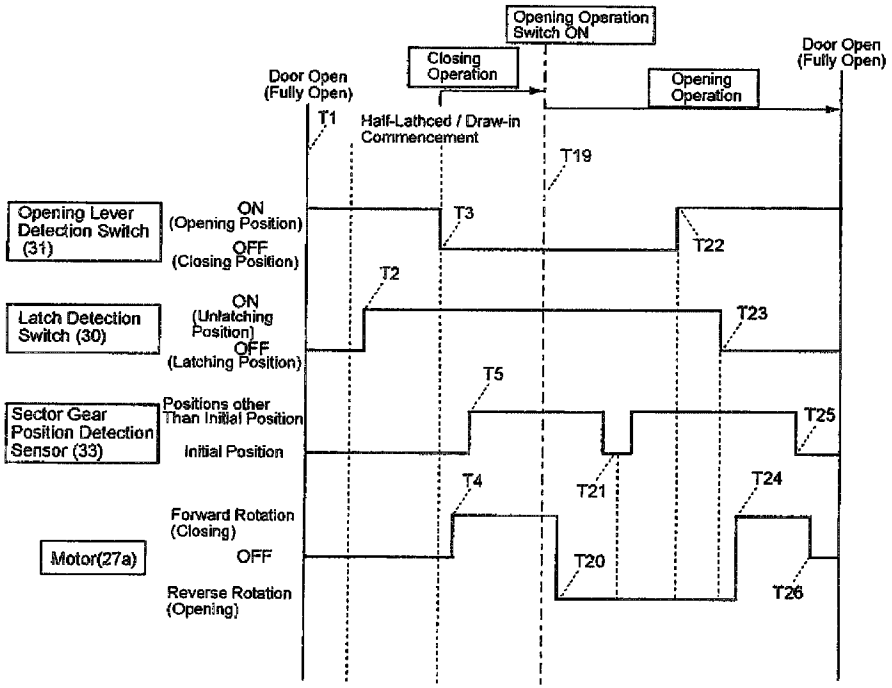
FIG. 14 is a timing chart in the case where an opening (closure-canceling) operation has been performed electrically at some point during the operation from the half-latched state to the fully-latched state.
Figure 15:
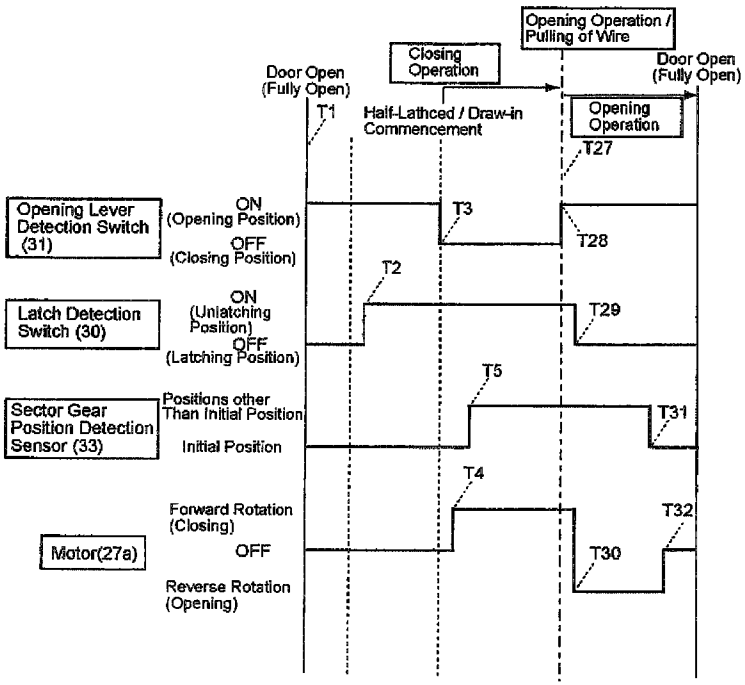
FIG. 15 is a timing chart in the case where the opening (closure-canceling) operation has been performed mechanically at some point during the operation from the half-latched state to the fully-latched state.

Operations of the door lock device 10 that has the above described structure will be hereinafter discussed with reference to FIG. 9 onwards. FIGS. 9 through 11 show mechanical operations of the door lock device 10, and FIGS. 13 through 15 show timing charts showing the electrical control of the door lock device 10. F1, F2, F3 and F4 shown in the structural drawings represent the directions of spring biasing forces exerted on the hook 12, the latch 13, the closing lever 20 and the opening lever 23, respectively. The rotational directions of each component which will be discussed in the following descriptions are those in FIGS. 9 through 11. In addition, as for the driving direction of the motor 27*a*, the driving direction to close (lock) the door and the driving direction to unlock the door are referred to as the forward rotational direction and the reverse rotational direction, respectively.

First, normal operations shown in FIG. 13 will be discussed hereinafter. FIG. 9 shows the door lock device 10 in a trunk door opened (fully opened) state shown by T1 in the timing chart shown in FIG. 13. At this stage, the hook 12 is in the striker releasing position, in which the second leg portion 12*d* is positioned over the striker entry groove 11*a* while the first leg portion 12*c* is retracted from over the striker entry groove 11*a*, and the latch 13 is in the latching position, in which the latch 13 has been rotated in a direction to approach the hook 12. As described above, when the latch 13 is in the latching position, the latch 13 is in a state where the switch operating piece 13*f* does not press the switch leaf 30*a* of the latch detection switch 30, so that the latch detection switch 30 is in a switch-OFF state. The positions of the hook 12 and the latch 13 are maintained by the biasing force F1 of the torsion spring 16 and the biasing force F2 of the torsion spring 17. More specifically, the hook 12 is prevented from further rotating in the F1-direction by the engagement of a side surface of the first leg portion 12*c* with an upright wall 11*i* of the base plate 11, and the latch 13 is prevented from further rotating in the F2-direction by the engagement of the guide projection 13*b* with an end of the latch guide groove 11*e*. At this stage, the latch pressure projection 12*f* is in contact with the stepped portion 13*e* (the latch pressure projection 12*f* appears to be in noncontact with the stepped portion 13*e* in FIG. 9 but is in contact with the stepped portion 13*e* in reality).

In the door-open state shown in FIG. 9, since the closing lever 20 is held in the draw-in releasing position by the engagement of the stopper surface 20*g* with a side surface of the stopper member 18, the control projection 21*c* of the interlinking lever 21 that is pivoted on the closing lever 20 via the pivot 22 is spaced upward from an end surface 23*f*3 formed at the lower end of the interlinking-lever control slot 23*f*, and the closing lever 20 is prevented from further rotating in the F3-direction of the extension spring 25. At this stage, the biasing force F3 of the extension spring 25 that is exerted on the closing lever 20 acts in a direction to bring the control projection 21*c* of the interlinking lever 21 into pressing contact with the inner arc surface 23*f*1 of the interlinking-lever control slot 23*f* (at this time, the control projection 21*c*, specifically the contact portion (point) 21*c*1 or 21*c*2 thereof, can come in contact with the inner arc surface 23*f*1 or the outer arc surface 23*f*2, or can be disengaged from both the inner arc surface 23*f*1 and the outer arc surface 23*f*2), while the interlinking lever 21 is held in the coupling disengaging position, in which the interlinking lever 21 cannot be coupled to the coupling projection 12*h* of the hook 12. In addition, at this time, the control projection 21*c* is located at Position A shown in FIG. 12 while the contact portions (points) 21*c*1 and 21*c*2 are located in the operational section 23*f*A as shown in FIG. 12. Additionally, the opening lever operating piece 26*c* of the sector gear 26 is in contact with the gear contact portion 23*h* of the opening lever 23, while the closing lever operating portion 26*d* is spaced from the second arm 20*c* of the closing lever 20 in the draw-in releasing position. This position corresponds to the initial position of the sector gear 26 that is detected by the sector gear position detection sensor 33. The opening lever 23 is prevented from rotating in the F4-direction of the extension spring 25 to be held in the opening position by the engagement of the rotation restriction wall 23*g* with the coupling projection 12*h* of the hook 12. As described above, when the opening lever 23 is in the opening position, the opening lever detection switch 31 is in an switch-ON state with the switch operating piece 23*e* pressing a switch leaf 31*a* of the opening lever detection switch 31. In addition, the ECU 32 detects a door-open state shown in FIG. 9 from a combination of an input signal indicating an OFF state of the latch detection switch 30 and an input signal indicating an ON state of the opening lever detection switch 31.

Upon the striker S entering the striker entry groove 11*a* and pressing the second leg portion 12*d* by a closing operation of the trunk door, the hook 12 is rotated in the counterclockwise direction toward a draw-in commencement position shown in FIG. 10 from the striker releasing position shown in FIG. 9 against the biasing force F1 of the torsion spring 16 while holding the striker S in the striker holding groove 12*b*. Thereupon, the latch pressure projection 12*f* of the hook 12 presses the stepped portion 13*e* of the latch 13 so that the latch 13 rotates in the clockwise direction to the unlatching position shown in FIG. 10 from the latching position shown in FIG. 9 against the biasing force F2 of the torsion spring 17. This rotation of the latch 13 to the unlatching position causes the switch operating piece 13*f* to press the switch leaf 30*a*, thus causing the latch detection switch 30 to be turned ON from the OFF state (T2).

The rotation restriction wall 23*g* of the opening lever 23 has a predetermined length in the lengthwise direction of the second arm 23*c*, and when the hook 12 is in the range from the striker releasing position shown in FIG. 9 to a position immediately before reaching the draw-in commencement position shown in FIG. 10, the rotation restriction wall 23*g* is in contact with the coupling projection 12*h* of the hook 12 to prevent the opening lever 23 from rotating toward the closing position (clockwise direction), so that the opening lever 23 remains held in the opening position. Thereafter, upon the hook 12 reaching the draw-in commencement position shown in FIG. 10, the coupling projection 12*h* of the hook 12 is disengaged from the position at which the coupling projection 12*h* is against the rotation restriction wall 23*g* so that the prevention of rotation of the hook 12 is released, and so that the opening lever 23 rotates to the closing position shown in FIG. 10 by the biasing force F4 of the extension spring 25 (T3). Upon the opening lever 23 rotating to the closing position, the outer arc surface 23*f*2 of the opening lever 23 presses the control projection 21*c* of the interlinking lever 21 toward the closing position, which causes the interlinking lever 21 to rotate in the clockwise direction about the pivot 22 by the biasing force F3 of the extension spring 25 from the coupling disengaging position shown in FIG. 9 to the coupling position shown in FIG. 10. As a result, the coupling projection 12*h* of the hook 12 comes in contact with the base of the coupling recess 21*b* of the interlinking lever 21, so that the hook 12 is held in the draw-in commencement position by the interlinking lever 21. This state corresponds to the half-latched state shown in FIG. 10. During the transition of the door lock device 10 from the door-open state shown in FIG. 9 to the half-latched state shown in FIG. 10 (including the time the hook 12 is in the striker releasing position and the time the hook 12 is in the draw-in commencement position), the stopper surface 20*g* continues to contact a side surface of the stopper member 18 at all times, so that the closing lever 20 is held in the draw-in releasing position even when the door lock device 10 is in the half-latched state. The rotation of the opening lever 23 to the closing position causes the switch operating piece 23*e* to stop pressing the switch leaf 31*a*, thus causing the opening lever detection switch 31 to be turned OFF from the ON state (T3). Thereafter, the ECU 32 detects the half-latched state shown in FIG. 10 from a combination of an input signal indicating an ON state of the latch detection switch 30 and an input signal indicating an OFF state of the opening lever detection switch 31.

The interlinking lever 21 and the opening lever 23 are both rotated in the clockwise direction when the door lock device 10 moves from the door fully opened state shown in FIG. 9 to the half-latched state shown in FIG. 10; however, during such clockwise rotations of the interlinking lever 21 and the opening lever 23, the control projection 21*c* of the interlinking lever 21 relatively changes the position thereof in the interlinking-lever control slot 23*f* in the widthwise direction thereof to change the state of the door lock device 10 to the state (shown in FIG. 10) in which the control projection 21*c* is in contact with the outer arc surface 23*f*2. Additionally, in this state, the interlinking lever 21 is prevented from rotating toward the coupling disengaging position by the engagement between the control projection 21*c* and the outer arc surface 23*f*2.

Upon the detection of the half-latched state, the ECU 32 drives the motor 27*a* of the motor unit 27 in the forward direction (T4). Thereupon, due to the engagement between the pinion 27*b* and the gear portion 26*b*, the sector gear 26 is rotated in the clockwise direction with respect to FIG. 10 (T5), and this rotation of the sector gear 26 causes the closing lever operating portion 26*d* to press the second arm 20*c* of the closing lever 20 to thereby rotate the closing lever 20 in the counterclockwise direction from the draw-in releasing position shown in FIG. 10 to the draw-in position shown in FIG. 11. This also causes the hook 12, which is formed integral with the closing lever 20 via the interlinking lever 21 (and is prevented from rotating toward the striker releasing position by the coupling recess 21*b*), to rotate in the counterclockwise direction from the draw-in commencement position shown in FIG. 10 to the striker holding position shown in FIG. 11, so that the striker S is drawn deeply into the striker entry groove 11*a* by the striker holding groove 12*b* of the hook 12. At this stage, the interlinking lever 21 moves integrally with the closing lever 20 about the pivot 14 while making the control projection 21*c* slide on the outer arc surface 23*f*2 of the interlinking-lever control slot 23*f* (at this time the rotational center of the outer arc surface 23*f*2 is coincident with the pivot 14) with the coupling recess 21*b* and the coupling projection 12*h* remaining engaged with each other. Additionally, during the time the opening lever 23 is held in the closing position, the interlinking lever 21 is prevented from rotating (rotating on the pivot 22) in a direction (toward the coupling disengaging position) to release the engagement between the coupling recess 21*b* and the coupling projection 12*h* by the engagement between the outer arc surface 23*f*2 and the control projection 21*c*. In other words, the outer arc surface 23*f*2 functions as a guide surface which determines the path of the rotational movement of the interlinking lever 21 during the closing operation of the trunk door from the half-latched state.

During the rotation of the combination of the hook 12 and the closing lever 20 in the draw-in direction of the striker S from the half-latched state shown in FIG. 10, the convex-shaped circular arc surface 12*g* that is formed at the end of the second leg portion 12*d* comes in sliding contact with the concave-shaped circular arc surface 13*d* of the latch 13, and the latch 13 is held in the unlatching position against the biasing force F2 of the torsion spring 17 in a manner similar to the case of the half-latched state shown in FIG. 10. During this stage, the opening lever 23 is also held in the closing position in a manner similar to the case in the half-latched state. Namely, a state where the latch detection switch 30 and the opening lever detection switch 31 are ON and OFF, respectively, continues. Thereafter, a rotation of the hook 12 to the striker holding position shown in FIG. 11 causes the convex-shaped circular arc surface 12*g* to escape upward from a position facing the concave-shaped circular arc surface 13*d* to thereby release the prevention of rotation of the latch 13 relative to the hook 12, which causes the latch 13 to rotate toward the latching position (in the counterclockwise direction) from the unlatching position by the biasing force F2 of the torsion spring 17 so that the rotation-restriction stepped portion 13*c* is engaged with the latch-engaging stepped portion 12*e* as shown in FIG. 11. Due to this engagement between the rotation-restriction stepped portion 13*c* and the latch-engaging stepped portion 12*e*, the hook 12 is prevented from rotating in the direction toward the striker releasing position, so that the door lock device 10 comes into the fully-latched state (the door fully-closed state), in which the striker S is completely held in the inner part of the striker entry groove 11*a*. In addition, at this time, the control projection 21*c* is located at Position B shown in FIG. 12 while the contact portions (points) 21*c*1 and 21*c*2 are located in the operational section 23*f*A as shown in FIG. 12. The counterclockwise rotation of the latch 13 when the rotation-restriction stepped portion 13*c* is brought into engagement with the latch-engaging stepped portion 12*e* causes the switch operating piece 13*f* to stop pressing the switch leaf 30*a*, thus causing the latch detection switch 30 to be turned OFF from the ON state (T6). Namely, each of the latch detection switch 30 and the opening lever detection switch 31 is turned OFF, thereby the fully-latched state being detected.

Upon the detection of the fully-latched state, the ECU 32 continues to drive the motor 27*a* in the forward direction by a predetermined overstroke amount in order to ensure a latched state (T7) and thereafter drives the motor 27*a* reversely in the door opening direction. This reverse driving of the motor 27*a* is for returning the sector gear 26 which has been rotated to the position shown in FIG. 11 by the closing operation to the initial position shown in FIG. 9, and the motor 27*a* is stopped (T9) upon the sector gear position detection sensor 33 detecting that the sector gear 26 has returned to the initial position thereof (T8). In this motor stopped state, the closing lever operating portion 26*d* is disengaged from the second arm 20*c*, so that the pressure force on the closing lever 20 from the sector gear 26 is released. However, as described above, the hook 12 is prevented from rotating in the clockwise direction with respect to FIG. 11 (in the direction toward the striker releasing position) due to the engagement thereof with the latch 13, and the closing lever 20 which is integrated with the hook 12 is also prevented from rotating via the interlinking lever 21 in the clockwise direction (in the direction toward the draw-in releasing position) against the biasing force F4 of the extension spring 25. In other words, the fully-latched state is maintained.

Upon the opening operation switch 34 being turned ON in the fully-latched state (T10), the motor 27*a* is driven in reverse (T11) to rotate the sector gear 26 in the counterclockwise direction from the initial position shown in FIG. 9 (T12). Thereupon, the opening lever operating piece 26*c* presses the gear contact portion 23*h*, which causes the opening lever 23 to rotate counterclockwise from the closing position shown in FIG. 11 toward the opening position against the biasing force F4 of the extension spring 25 so that the opening lever detection switch 31 is turned ON from the OFF state (T13). This counterclockwise rotation of the opening lever 23 causes the inner arc surface 23*f*1 of the interlinking-lever control slot 23*f* to press the control projection 21*c*, thus causing the interlinking lever 21 to rotate (rotate on its axis) counterclockwise (toward the coupling disengaging position) about the pivot 22. Thereupon, this rotation of the interlinking lever 21 causes the engagement between the coupling recess 21*b* and the coupling projection 12*h* to be released, to thereby release the coupling (via the interlocking lever 21) between the hook 12 and the closing lever 20 from each other. In addition, the latch pressure projection 21*d* of the interlinking lever 21 presses the pressed piece 13*g* of the latch 13 to rotate the latch 13 in the clockwise direction from the latching position to the unlatching position against the biasing force F2 of the torsion spring 17 (T14).

This rotation of the latch 13 to the unlatching position causes the engagement between the rotation-restriction stepped portion 13*c* and the latch-engaging stepped portion 12*e*, i.e., the prevention of rotation of the hook 12, to be released, which causes the hook 12 to rotate toward the striker releasing position shown in FIG. 9 from the striker holding position shown in FIG. 11 by the biasing force F1 of the torsion spring 16. The closing lever 20, the engagement thereof with the hook 12 having being released, is also rotated clockwise toward the draw-in releasing position shown in FIGS. 9 and 10 from the draw-in position shown in FIG. 11 by the biasing force F4 of the extension spring 25; in accordance with this rotation, the control projection 21*c* of the interlinking lever 21 moves in the interlinking-lever control slot 23*f* toward the lower end (the end surface 23*f*3) thereof while sliding on the inner arc surface 23*f*1. Additionally, during the time the opening lever 23 is held in the opening position, the interlinking lever 21 is prevented from rotating (rotating on the pivot 22) in a direction (toward the coupling position) to make the coupling recess 21*b* and the coupling projection 12*h* re-engaged with each other by the engagement between the inner arc surface 23*f*1 and the control projection 21*c*. In other words, the inner arc surface 23*f*1 functions as a guide surface which determines the path of the rotational movement of the interlinking lever 21 during the opening operation of the trunk door from the fully-latched state.

Upon the interlinking lever 21 moving downward by a predetermined amount of movement following the rotation of the closing lever 20 toward the draw-in releasing position, the pressure of the latch pressure projection 21*d* of the interlinking lever 21 against the pressed piece 13*g* of the latch 13 in a direction toward the unlatching position is released. However, during the time until the hook 12 reaches the striker releasing position shown in FIG. 9 from the moment the engagement between the rotation-restriction stepped portion 13*c* and the latch-engaging stepped portion 12*e* is released, the convex-shaped circular arc surface 12*g* of the second leg portion 12*d* of the hook 12 presses the concave-shaped circular arc surface 13*d* of the latch 13 so that the latch 13 continues to be held in the unlatching position against the biasing force F2 of the torsion spring 17. More specifically, the amount of rotation of the closing lever 20 from the draw-in position (FIG. 11) to the draw-in releasing position (FIG. 10) is substantially the same as the amount of rotation of the hook 12 from the striker holding position (FIG. 11) to the draw-in commencement position (FIG. 10), and when performing the opening operation, the pressure of the interlinking lever 21 on the latch 13 toward the unlatching position is released at a stage before the closing lever 20 reaches the draw-in releasing position shown in FIG. 10. On the other hand, the pressure of the circular arc surface 12*g* of the hook 12 on the latch 13 in a direction toward the unlatching position continues for a longer period of time than the pressure of the interlinking lever 21 on the latch 13, and it is not until the engagement between the convex-shaped circular arc surface 12*g* and the concave-shaped circular arc surface 13*d* is released, upon the latch pressure projection 12*f* moving over the stepped portion 13*e* of the latch 13 after the hook 12 reaches the striker releasing position (FIG. 9), that the latch 13 is allowed to rotate to the latching position. Thereafter, the latch 13 rotates and returns to the latching position from the unlatching position by the biasing force F2 of the torsion spring 17 (T15) after the aforementioned allowance of rotation of the latch 13 takes place. Namely, the aforementioned signals representing a door-open state that respectively indicate an OFF state of the latch detection switch 30 and an ON state of the opening lever detection switch 31 are not input until the hook 12 reaches the striker releasing position.

Upon the detection of the door-open state, the ECU 32 continues to drive the motor 27*a* in the reverse direction by a predetermined overstroke amount in order to ensure a latch released state (T16) and thereafter drives the motor 27*a* forwardly in the door closing direction. This forward driving of the motor 27*a* is for returning the sector gear 26, which has been rotated counterclockwise from the initial position shown in FIG. 9 when performing the opening operation, to the initial position, and the motor 27*a* is stopped (T18) upon the sector gear position detection sensor 33 detecting that the sector gear 26 has returned to the initial position thereof (T17), so that the door lock device 10 returns to the door-open state shown in FIG. 9.

FIG. 14 shows a process performed in the case where the opening (closure-canceling) operation is performed by an operation of the opening operation switch 34 during the time the door lock device 10 moves from the half-latched state shown in FIG. 10 until coming into the fully-latched state shown in FIG. 11. Operations are the same as those of the above described normal operations until when the motor 27*a* is driven forward, in response to an input of the signal representing the half-latched state (in which the latch detection switch 30 is ON and the opening lever detection switch 31 is OFF), to rotate the sector gear 26 clockwise with respect to FIG. 10 to thereby press and rotate the closing lever 20 toward the draw-in position (T5). At this stage, upon the opening operation switch 34 being turned ON before the door lock device 10 comes into the fully-latched state (T19), the ECU 32 switches the driving direction of the motor 27*a* from forward to reverse (T20). Thereupon, the sector gear 26 stops pressing the closing lever 20 via the closing lever operating portion 26*d*. This causes the combination of the hook 12 and the closing lever 20 to return to the half-latched state shown in FIG. 10 by the biasing force F1 of the torsion spring 16 and the biasing force F3 of the extension spring 25. Although the sector gear 26 temporarily returns to the initial position (T21), the sector gear 26 continues to be driven in the reverse direction without the motor 27*a* being stopped. Thereupon, the opening lever operating piece 26*c* of the sector gear 26 presses the gear contact portion 23*h* to rotate the opening lever 23 counterclockwise toward the opening position from the closing position against the biasing force F4 of the extension spring 25, and this operation is detected by the opening lever detection switch 31 (T22).

When the opening lever 23 rotates to the opening position in the half-latched state shown in FIG. 10, a predetermined idle running time (corresponding to the section in which the contact point of the control projection 21*c* is switched from the outer arc surface 23*f*2 to the inner arc surface 23*f*1) elapses, and thereafter, the inner arc surface 23*f*1 of the interlinking-lever control slot 23*f* presses the control projection 21*c*, which causes the interlinking lever 21 to rotate from the coupling position, in which the interlinking lever 21 is engaged with the coupling projection 12*h* of the hook 12, to the coupling disengaging position. This causes the engagement between the hook 12 and the closing lever 20 to be released, thus causing the hook 12 to solely rotate toward the striker releasing position shown in FIG. 9 from the draw-in commencement position shown in FIG. 10 by the biasing force F1 of the torsion spring 16. Upon the hook 12 reaching the striker releasing position, the pressure of the convex-shaped circular arc surface 12*g* of the second leg portion 12*d* against the concave-shaped circular arc surface 13*d* is released, so that the latch 13 rotates from the latching position to the unlatching position, and this operation is detected by the latch detection switch 30 (T23). This produces a signal indicating the door-open state, in which the latch detection switch 30 is OFF and the opening lever detection switch 31 is ON. Upon input of this signal, similar to the case when normal operations are performed, the motor 27*a* is driven forward after being driven reverse continuously by a predetermined amount of overstroke (T24) to return the sector gear 26 to the initial position (T25) and subsequently the door lock device 10 returns to the door-open state shown in FIG. 9 by stopping the motor 27*a* (T26).

FIG. 15 shows a process performed in the case where a mechanical opening (closure-canceling) operation is performed via the opening operation wire W instead of the opening operation switch 34 during the time the door lock device 10 moves from the half-latched state shown in FIG. 10 until coming into the fully-latched state shown in FIG. 11. Operations are the same as those of the above described normal operations until when the motor 27*a* is driven forward upon detection of the signal representing the half-latched state (in which the latch detection switch 30 is ON and the opening lever detection switch 31 is OFF) to rotate the sector gear 26 clockwise with respect to FIG. 10 to thereby press and rotate the closing lever 20 (T5). At this stage, pulling of the opening operation wire W by operating the aforementioned key apparatus or emergency release handle (T27) causes a force pulling the wire hooking portion 23*d* upward to be applied on the wire hooking portion 23*d*, thus causing the opening lever 23 to rotate from the closing position to the opening position, so that the opening lever detection switch 31 is switched from the OFF state (closing position) to the ON state (opening position) (T28). This rotation of the opening lever 23 causes the inner arc surface 23*f*1 of the interlinking-lever control slot 23*f* to press the control projection 21*c* of the interlinking lever 21, thus causing the interlinking lever 21 to rotate (rotate on its axis) counterclockwise about the pivot 22 to thereby be disengaged from the coupling projection 12*h* of the hook 12. Accordingly, the hook 12, the engagement thereof with the closing lever 20 being released, is rotated toward the striker releasing position shown in FIG. 9 by the biasing force F1 of the torsion spring 16. Subsequently, upon the hook 12 reaching the striker releasing position, the pressure of the convex-shaped circular arc surface 12*g* of the second leg portion 12*d* on the concave-shaped circular arc surface 13*d* is released, which causes the latch 13 to rotate from the latching position to the unlatching position, so that the latch detection switch 30 is turned OFF from the ON state (T29). The door-open state is detected from a combination of this OFF state of the latch detection switch 30 and the ON state of the opening lever detection switch 31. Upon this detection of the door-open state, the ECU 32 switches the driving direction of the motor 27*a* from forward, which is for closing, to reverse (T30), which causes the sector gear 26 to rotate toward the initial position from the position where the sector gear 26 presses the closing lever 20. Upon the sector gear position detection sensor 33 detecting that the sector gear 26 returns to the initial position thereof (T31), the motor 27*a* is stopped (T32); consequently, the door lock device 10 returns to the door-open state shown in FIG. 9.

As described above, in the present embodiment of the door lock device 10, the biasing force of the extension spring 25 is transmitted to the interlinking lever 21 via the closing lever 20; however, upon the closing lever 20 being positioned in the draw-in releasing position by contact engagement of the stopper surface 20*g* with a side surface of the stopper member 18 (i.e., upon the hook 12 being positioned in the striker releasing position), the control projection 21*c* of the interlinking lever 21 is held at a position spaced from one end surface 23*f*3 of both end surfaces of the control groove 23*f* of the opening lever 23 in the lengthwise direction thereof. Therefore, the control projection 21*c* does not dig into the end surface 23*f*3 of the control groove 23, and accordingly, when the hook 12 is rotated toward the striker holding position by the striker S afterwards, the control projection 21*c* smoothly moves relative to the control groove 23*f*. Consequently, rotations of the interlinking lever 21 and the opening lever 23 do not become unsmooth, so that the door lock device 10 can move to the fully-latched state smoothly.

In addition, upon the closing lever 20 being positioned in the draw-in releasing position by contact engagement of the stopper surface 20*g* with a side surface of the stopper member 18 (i.e., upon the hook 12 being positioned in the striker releasing position), the contact portions (points) 21*c*1 and 21*c*2 of the control projection 21*c* are located in the operational section 23*f*A (at this time, the contact portions (points) 21*c*1 and 21*c*2 can be in contact with the inner arc surface 23*f*1 or the outer arc surface 23*f*2, or disengaged from the inner arc surface 23*f*1 and the outer arc surface 23*f*2, respectively). In this manner, the contact portions (points) 21*c*1 and 21*c*2 of the control projection 21*c* do not come in contact with the portions of the inner arc surface 23*f*1 and the outer arc surface 23*f*2 in the non-operational sections 23*f*B, respectively; accordingly, when the hook 12 is rotated toward the striker holding position afterwards, the control projection 21*c* is guided to move smoothly by the portion of the inner arc surface 23*f*1 in the operational section 23*f*A, so that the door lock device 10 can move to the fully-latched state smoothly. In this connection, the entire part of the control projection 21*c* can be positioned in the operational section 23*f*A when the closing lever 20 is positioned in the draw-in releasing position by contact engagement of the stopper surface 20*g* with a side surface of the stopper member 18.

Additionally, the latch 13 is made to return to the latching position from the unlatching position upon the hook 12 reaching the striker releasing position, and it is detected that the door is open (latch release/lock release) by referring to this returning operation. This configuration makes it possible to detect the door-open state without directly detecting the position of the hook 12, i.e., even if there is no sufficient space for the installation of a detector around the hook 12. In addition, in the door lock device 10, the components thereof, including the latch detection switch 30 and the opening lever detection switch 31 that serve as detectors, are arranged at predetermined positions on the base plate 11 as a unit, and accordingly, the door lock device 10 is easy to handle and requires no troublesome adjustment when installed to a vehicle. Additionally, since the latch 13 does not return to the latching position until the hook 12 reaches the striker releasing position, i.e., until the door lock is fully released, even in the case where the door lock device 10 stops during the opening operation due to some error, there is no possibility of this condition being mistakenly detected as a door open condition. For instance, if the signals indicating the door-open state (a combination of a signal indicating an OFF state of the latch detection switch 30 and a signal indicating an ON state of the opening lever detection switch 31) are not input within a predetermined period of time during the opening operation, this condition is determined as an error in the opening operation, so that safety can be secured by performing an appropriate process such as a motor stopping process or a warning issuing process.

Additionally, the latch controller that achieves the above described operations of the latch 13 is configured from a structure having excellent space utilization which includes the small interlinking lever 21 that is pivoted on the closing lever 20 and the interlinking-lever control slot 23*f* that is formed in the opening lever 23, etc., thus being capable of avoiding an increase in size of the door lock device 10.

Although the present invention has been described based on the illustrated embodiment, the present invention is not limited solely to this particular embodiment. For instance, although the illustrated embodiment is a door lock device of a trunk door, the present invention can also be applied to a door other than a trunk door.

In addition, the door lock device can be structured such that the stopper surface 20*g* of the closing lever 20 having rotated to the draw-in releasing position is received by an inner surface (stopper) of the support projection 11*j* by the omission of the stopper member 18.

Additionally, the whole areas of the inner arc surface 23*f*1 and the outer arc surface 23*f*2 can each be formed into the same shape (e.g., the same circular arcuate shape) so that a part and the other part of each whole area are formed as an operational section and a non-operational section, respectively.

Figure 16:
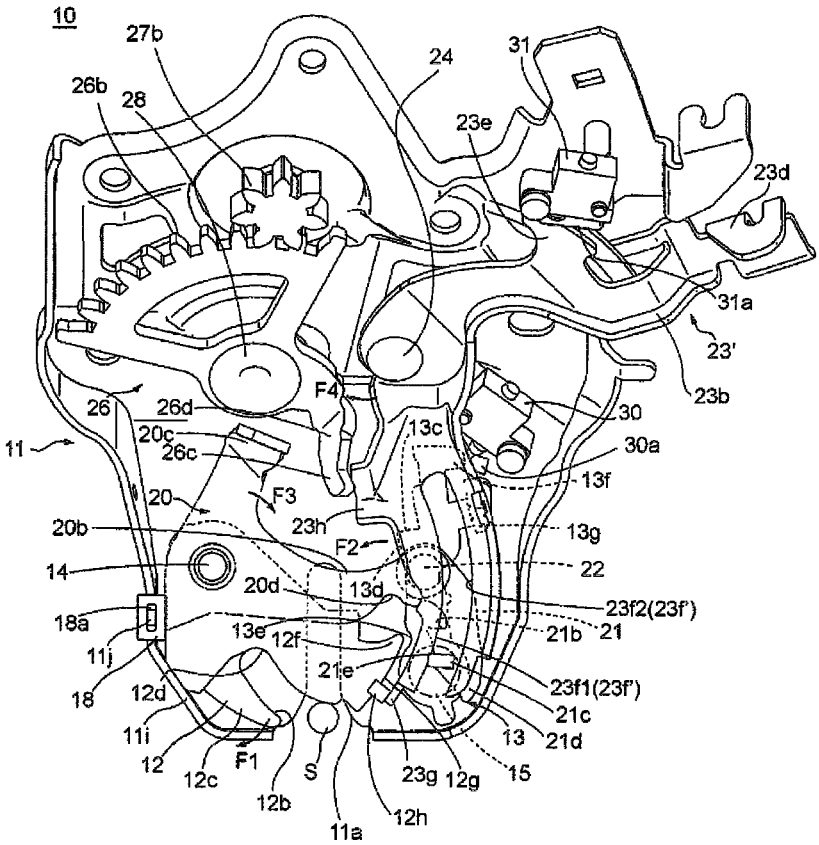
FIG. 16 is a plan view of a modified embodiment of that shown in FIG. 9.

Additionally, the lower end of an interlinking-lever control slot 23*f*' can be opened like an opening lever 23' shown in FIG. 16. In this case also, upon the closing lever 20 being positioned in the draw-in releasing position by contact engagement of the stopper surface 20*g* with a side surface of the stopper member 18 (i.e., upon the hook 12 being positioned in the striker releasing position), the contact portions (points) 21*c*1 and 21*c*2 of the control projection 21*c* are located in the operational section 23*f*A. Accordingly, when the hook 12 is rotated toward the striker holding position afterwards, the control projection 21*c* is guided to move smoothly by the portion of the inner arc surface 23*f*1 in the operational section 23*f*A, which makes it possible for the door lock device 10 to move to the fully-latched state smoothly.

INDUSTRIAL APPLICABILITY

The door lock device according to the present invention has industrial applicability because, when the hook is rotated toward the striker holding position by the striker after the closing lever is positioned in the draw-in releasing position by the stopper, rotations of the interlinking lever and the opening lever do not become unsmooth, which makes it possible for the door lock device to move to a locked state smoothly.

EXPLANATIONS OF LETTERS OR NUMERALS

10 Door Lock Device
11 Base Plate
11*a* Striker Entry Groove
11*j* Support Projection
12 Hook
12*b* Striker Holding Groove
12*e* Latch-Engaging Stepped Portion (Engaging Portion)
12*f* Latch Pressure Projection (Latch Controller)
12*g* Circular Arc Surface (Latch Controller/latch Holder)
12*h* Coupling Projection (Opening Lever Holder)
13 Latch
13*c* Rotation-Restriction Stepped Portion
13*d* Circular Arc Surface (Latch Controller/Latch Holder)
13*e* Stepped Portion (Latch Controller)
13*f* Switch Operating Piece
13*g* Pressed Piece (Latch Controller/Interlinking-Lever Linkup Portion)
16 Torsion Spring
17 Torsion Spring (Latch Biaser)
18 Stopper Member (Stopper)
20 Closing Lever
20*b* First Arm
20*c* Second Arm
20*d* Recess
20*g* Stopper Surface (Stopper)

21 Interlinking Lever (Latch Controller)
21*b* Coupling Recess
21*c* Control Projection
21*d* Latch Pressure Projection
23 Opening Lever (Control Lever)
23*b* First Arm
23*c* Second Arm (Arm Portion)
23*e* Switch Operating Piece
23*f* Interlinking-Lever Control Slot (Control Slot)
23*f*A Operational Section
23*f*B Non-operational Section
23*f*1 Inner Arc Surface (Projection Operating Surface) 23*f*2 Outer Arc Surface (Opposed Guide Surface)
23*f*3 End Surface
25 Extension Spring (Closing Lever Biaser/Control Lever Biaser)
26 Sector Gear (Motor-Operated Driving Mechanism)
26*c* Opening Lever Operating Piece
26*d* Closing Lever Operating Portion
27 Motor Unit
27*a* Motor
27*b* Pinion
30 Latch Detection Switch (Detector/First Switch)
31 Opening Lever Detection Switch (Detector/Second Switch)
32 Electronic Control Unit (ECU)
33 Sector Gear Position Detection Sensor
34 Opening Operation Switch
S Striker
W Opening Operation Wire

The invention claimed is:

1. A door lock device for holding a door in a fully-closed state, said door being capable of being opened and closed relative to a vehicle body, said door lock device comprising:

a base plate and a striker which are installed to one and the other of said door and said vehicle body;

a hook which is supported by said base plate to be rotatable between a striker holding position for holding said striker, a striker releasing position for releasing said striker and a draw-in commencement position between said striker holding position and said striker releasing position, said hook being biased toward said striker releasing position;

a closing lever which is supported by said base plate thereon to be coaxially rotatable with said hook and rotates between a draw-in position, at which said closing lever is positioned toward said striker holding position of said hook, and a draw-in releasing position, at which said closing lever is positioned toward said striker releasing position of said hook;

a motor-operated driving mechanism provided with a motor which does not operate when said hook is located at a position toward said striker releasing position from said draw-in commencement position, and which operates to rotate said closing lever to said draw-in position when said hook moves to said draw-in commencement position from said striker releasing position and wherein when said motor drive mechanism is in direct contact with said closing lever such that said closing lever is directly pressed and rotated by said motor drive mechanism;

a closing/control lever biaser comprising a spring which biases said closing lever toward said draw-in releasing position at all times;

an interlinking lever which is in direct connection with said closing lever such that said interlinking lever is pivoted on said closing lever and rotatable between a coupling position at which said interlinking lever is engaged with said hook so as to make said closing lever and said hook integral with each other via said interlinking lever, and a coupling disengaging position at which said interlinking lever is disengaged from said hook to allow said closing lever and said hook to rotate relative to each other;

a control lever which is rotatably supported by said base plate thereon and rotates between a coupling assisting position and a coupling-disengagement assisting position;

wherein said closing/control lever biaser biases said control lever toward said coupling assisting position;

a control slot which is composed of an elongated hole formed in said control lever, in which a control projection of the interlinking lever is engaged to be movable relative to said control slot, which moves said interlinking lever toward said coupling position via said control projection when said control lever rotates toward said coupling assisting position, and which moves said interlinking lever toward said coupling disengaging position via said control projection when said control lever rotates toward said coupling-disengagement assisting position; and a stopper which prevents said closing lever, rotated to said draw-in releasing position, from rotating by a biasing force of said closing/control lever biaser to thereby make said control projection spaced from an end surface of said control slot in a lengthwise direction thereof.

2. The door lock device according to claim 1, wherein said stopper prevents said closing lever in said draw-in releasing position from rotating at all times when said hook is positioned in one of said striker releasing position, said draw-in commencement position and a position between said striker releasing position and said draw-in commencement position.

3. The door lock device according to claim 1, wherein said stopper comprises a stopper member provided on said base plate, and a stopper surface formed on said closing lever.

4. A door lock device for holding a door in a fully-closed state, said door being capable of being opened and closed relative to a vehicle body, said door lock device comprising:

a base plate and a striker which are installed to one and the other of said door and said vehicle body;

a hook which is supported by said base plate to be rotatable between a striker holding position for holding said striker, a striker releasing position for releasing said striker and a draw-in commencement position between said striker holding position and said striker releasing position, said hook being biased toward said striker releasing position;

a closing lever which is supported by said base plate thereon to be coaxially rotatable with said hook and rotates between a draw-in position, at which said closing lever is positioned toward said striker holding position of said hook, and a draw-in releasing position, at which said closing lever is positioned toward said striker releasing position of said hook;

a motor-operated driving mechanism provided with a motor which does not operate when said hook is located at a position toward said striker releasing position from said draw-in commencement position, and which operates to rotate said closing lever to said draw-in position when said hook moves to said draw-in commencement position from said striker releasing position;

a closing/control lever biaser comprising a spring which biases said closing lever toward said draw-in releasing position at all times;

an interlinking lever which is pivoted on said closing lever and rotatable between a coupling position at which said interlinking lever is engaged with said hook so as to make said closing lever and said hook integral with each other via said interlinking lever and a coupling disengaging position at which said interlinking lever is disengaged from said hook to allow said closing lever and said hook to rotate relative to each other;

a control lever which is rotatably supported by said base plate thereon and rotates between a coupling assisting position and a coupling-disengagement assisting position;

wherein said closing/control lever biaser biases said control lever toward said coupling assisting position;

a control slot which is composed of an elongated hole formed in said control lever, and which includes an operational section and a non-operational section, wherein said operational section is for moving said interlinking lever toward said coupling position by making an inner surface of said operational section be in contact with a control projection of the interlinking lever, which is relatively movably engaged in said control slot, when said control lever rotates toward said coupling assisting position and for moving said interlinking lever toward said coupling disengaging position when said control lever rotates toward said coupling-disengagement assisting position, and wherein an inner surface of said non-operational section does not come in contact with said control projection; and a stopper which prevents said closing lever, rotated to said draw-in releasing position, from rotating by a biasing force of said closing/control lever biaser to thereby position said control projection in said operational section of said control slot.

5. The door lock device according to claim 4, wherein said stopper prevents said closing lever in said draw-in releasing position from rotating at all times when said hook is positioned in one of said striker releasing position, said draw-in commencement position and a position between said striker releasing position and said draw-in commencement position.

6. The door lock device according to claim 4, wherein said stopper comprises a stopper member provided on said base plate, and a stopper surface formed on said closing lever.

* * * * *